US005918550A

United States Patent [19]

Weir et al.

[11] Patent Number: 5,918,550

[45] Date of Patent: Jul. 6, 1999

[54] CHAIR MOUNTED TABLE

[76] Inventors: Dave Weir, 7 Julie Drive, Thorold, Ontario, Canada, L2V 4L4; Jeff Mannell, RR 1, Font Hill, Ontario, Canada, L0S 1E6

[21] Appl. No.: 09/057,755

[22] Filed: Apr. 9, 1998

[51] Int. Cl.[6] ..... A47B 39/00

[52] U.S. Cl. ..... 108/42; 108/25; 108/157.11; 108/152; 297/135

[58] Field of Search ..... 108/42, 25, 157.11, 108/157.18, 49, 127, 134, 135, 148, 152, 47, 48; 297/135, 188.2

[56] References Cited

U.S. PATENT DOCUMENTS 2,601,888 7/1952 Schopper .
2,658,294 11/1953 Hull ..... 108/48
2,833,608 5/1958 Tobias .
2,838,353 6/1958 Emmert .
2,858,056 10/1958 Ownby .
3,057,670 10/1962 Russo .
3,894,496 7/1975 Phillips et al. .
4,357,881 11/1982 De Long .
5,158,023 10/1992 Allen .
5,170,720 12/1992 Scheurer .
5,419,265 5/1995 Zimmerman .
5,542,359 8/1996 Polries .

*Primary Examiner*—Peter M. Cuomo
*Assistant Examiner*—Hanh Tran

[57] ABSTRACT

A lawn chair attachment is provided including a table with a clamp for securing the table to a lawn chair. Also included is a leg connected to the table for supporting the same.

4 Claims, 2 Drawing Sheets

CHAIR MOUNTED TABLE

BACKGROUND OF THE INVENTION

1. Field of the Invention

The present invention relates to chair attachments and more particularly pertains to a new chair mounted table for providing a resting surface adjacent to a lawn chair or the like.

2. Description of the Prior Art

The use of chair attachments is known in the prior art. More specifically, chair attachments heretofore devised and utilized are known to consist basically of familiar, expected and obvious structural configurations, notwithstanding the myriad of designs encompassed by the crowded prior art which have been developed for the fulfillment of countless objectives and requirements.

Known prior art chair attachments include U.S. Pat. No. 4,063,701; U.S. Pat. No. 5,295,650; U.S. Pat. No. 5,356,107; U.S. Pat. No. Des. 341,994; U.S. Pat. No. 3,233,940; and U.S. Pat. No. 2,711,872.

In these respects, the chair mounted table according to the present invention substantially departs from the conventional concepts and designs of the prior art, and in so doing provides an apparatus primarily developed for the purpose of providing a resting surface adjacent to a lawn chair or the like.

SUMMARY OF THE INVENTION

In view of the foregoing disadvantages inherent in the known types of chair attachments now present in the prior art, the present invention provides a new chair mounted table construction wherein the same can be utilized for providing a resting surface adjacent to a lawn chair or the like.

The general purpose of the present invention, which will be described subsequently in greater detail, is to provide a new chair mounted table apparatus and method which has many of the advantages of the chair attachments mentioned heretofore and many novel features that result in a new chair mounted table which is not anticipated, rendered obvious, suggested, or even implied by any of the prior art chair attachments, either alone or in any combination thereof.

To attain this, the present invention generally comprises a table having a square planar top. A peripheral lip is integrally coupled to a periphery of the top and extends downwardly therefrom a constant predetermined distance. The top of the table has a pair of cylindrical recesses formed therein adjacent to a side edge thereof. A pair of clamps are provided each having a length of about ⅓ that of the table. Such clamps further have a C-shaped cross-section along an entire length thereof. The clamps are each situated about a horizontal axis and are connected to a central extent of opposite side edges of the peripheral lip of the table. In use, the clamps function for snappily coupling with a horizontal bar of a lawn chair seat. Next provided is a leg clamping assembly including a plurality of snap locks. Each of the snap locks have a length which is less than ¼ that of the clamps and a C-shaped cross-section along an entire length thereof thereby defining an opening. As shown in FIG. 3, the snap locks include two pairs of first snap locks situated about a first horizontal axis and mounted to a bottom surface of the top of the table adjacent to the opposite side edges of the peripheral lip. It should be noted that the first snap locks reside along a common axis which is parallel with that of the opposite side edges of the peripheral lip. The snap locks further include a pair of second snap locks positioned about a vertical axis. The second snap locks are mounted to an interior surface of a central extent of an associated one of the opposite side edges of the peripheral lip. Finally, a third snap lock is situated about a second horizontal axis perpendicular with the first horizontal axis. Further, the third snap lock is coupled to a central extent of the bottom surface of the top of the table. Lastly, a T-shaped leg includes a horizontal extent which is snappily and rotatably coupled between one of the pairs of the first snap locks. A vertical extent of the leg is thus pivotable between a horizontal orientation and a vertical orientation. In the horizontal orientation, the vertical extent is engaged with the third snap lock. Further, the vertical extent is engaged with a corresponding one of the second snap locks when in the vertical orientation. As shown in the Figures, the vertical extent includes two telescoping components for permitting an adjustable length.

There has thus been outlined, rather broadly, the more important features of the invention in order that the detailed description thereof that follows may be better understood, and in order that the present contribution to the art may be better appreciated. There are additional features of the invention that will be described hereinafter and which will form the subject matter of the claims appended hereto.

In this respect, before explaining at least one embodiment of the invention in detail, it is to be understood that the invention is not limited in its application to the details of construction and to the arrangements of the components set forth in the following description or illustrated in the drawings. The invention is capable of other embodiments and of being practiced and carried out in various ways. Also, it is to be understood that the phraseology and terminology employed herein are for the purpose of description and should not be regarded as limiting.

As such, those skilled in the art will appreciate that the conception, upon which this disclosure is based, may readily be utilized as a basis for the designing of other structures, methods and systems for carrying out the several purposes of the present invention. It is important, therefore, that the claims be regarded as including such equivalent constructions insofar as they do not depart from the spirit and scope of the present invention.

Further, the purpose of the foregoing abstract is to enable the U.S. Patent and Trademark Office and the public generally, and especially the scientists, engineers and practitioners in the art who are not familiar with patent or legal terms or phraseology, to determine quickly from a cursory inspection the nature and essence of the technical disclosure of the application. The abstract is neither intended to define the invention of the application, which is measured by the claims, nor is it intended to be limiting as to the scope of the invention in any way.

It is therefore an object of the present invention to provide a new chair mounted table apparatus and method which has many of the advantages of the chair attachments mentioned heretofore and many novel features that result in a new chair mounted table which is not anticipated, rendered obvious, suggested, or even implied by any of the prior art chair attachments, either alone or in any combination thereof.

It is another object of the present invention to provide a new chair mounted table which may be easily and efficiently manufactured and marketed.

It is a further object of the present invention to provide a new chair mounted table which is of a durable and reliable construction.

An even further object of the present invention is to provide a new chair mounted table which is susceptible of a low cost of manufacture with regard to both materials and labor, and which accordingly is then susceptible of low prices of sale to the consuming public, thereby making such chair mounted table economically available to the buying public.

Still yet another object of the present invention is to provide a new chair mounted table which provides in the apparatuses and methods of the prior art some of the advantages thereof, while simultaneously overcoming some of the disadvantages normally associated therewith.

Still another object of the present invention is to provide a new chair mounted table for providing a resting surface adjacent to a lawn chair or the like.

Even still another object of the present invention is to provide a new chair mounted table that includes a table with a clamp for securing the table to a lawn chair. Also included is a leg connected to the table for supporting the same.

These together with other objects of the invention, along with the various features of novelty which characterize the invention, are pointed out with particularity in the claims annexed to and forming a part of this disclosure. For a better understanding of the invention, its operating advantages and the specific objects attained by its uses, reference should be made to the accompanying drawings and descriptive matter in which there are illustrated preferred embodiments of the invention.

BRIEF DESCRIPTION OF THE DRAWINGS

The invention will be better understood and objects other than those set forth above will become apparent when consideration is given to the following detailed description thereof. Such description makes reference to the annexed drawings wherein.

DESCRIPTION OF THE PREFERRED EMBODIMENT

Figure 1:
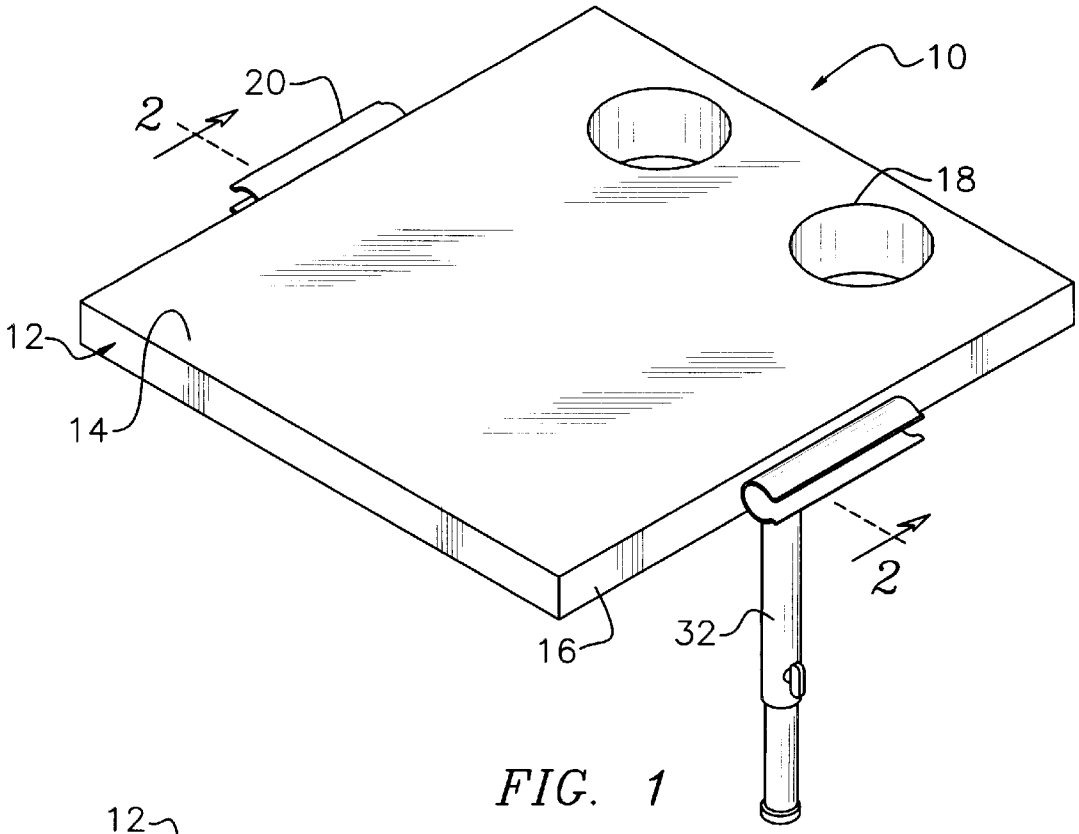
FIG. 1 is a perspective view of a new chair mounted table according to the present invention.
Figure 2:
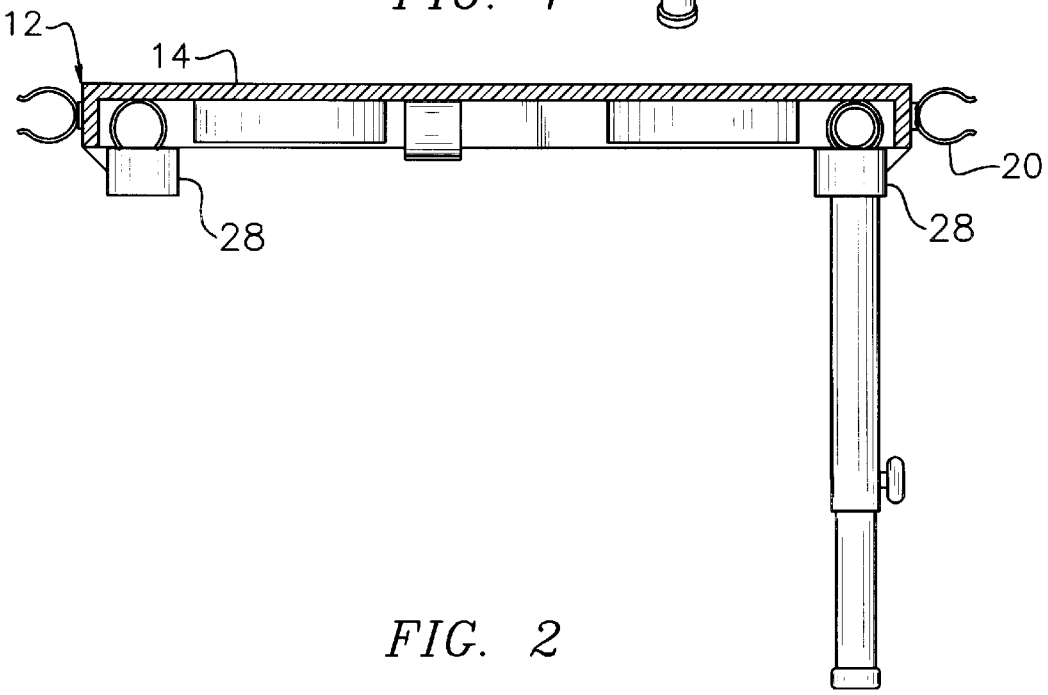
FIG. 2 is a side cross-sectional view of the present invention taken along line 2—2 shown in FIG. 1.
Figure 3:
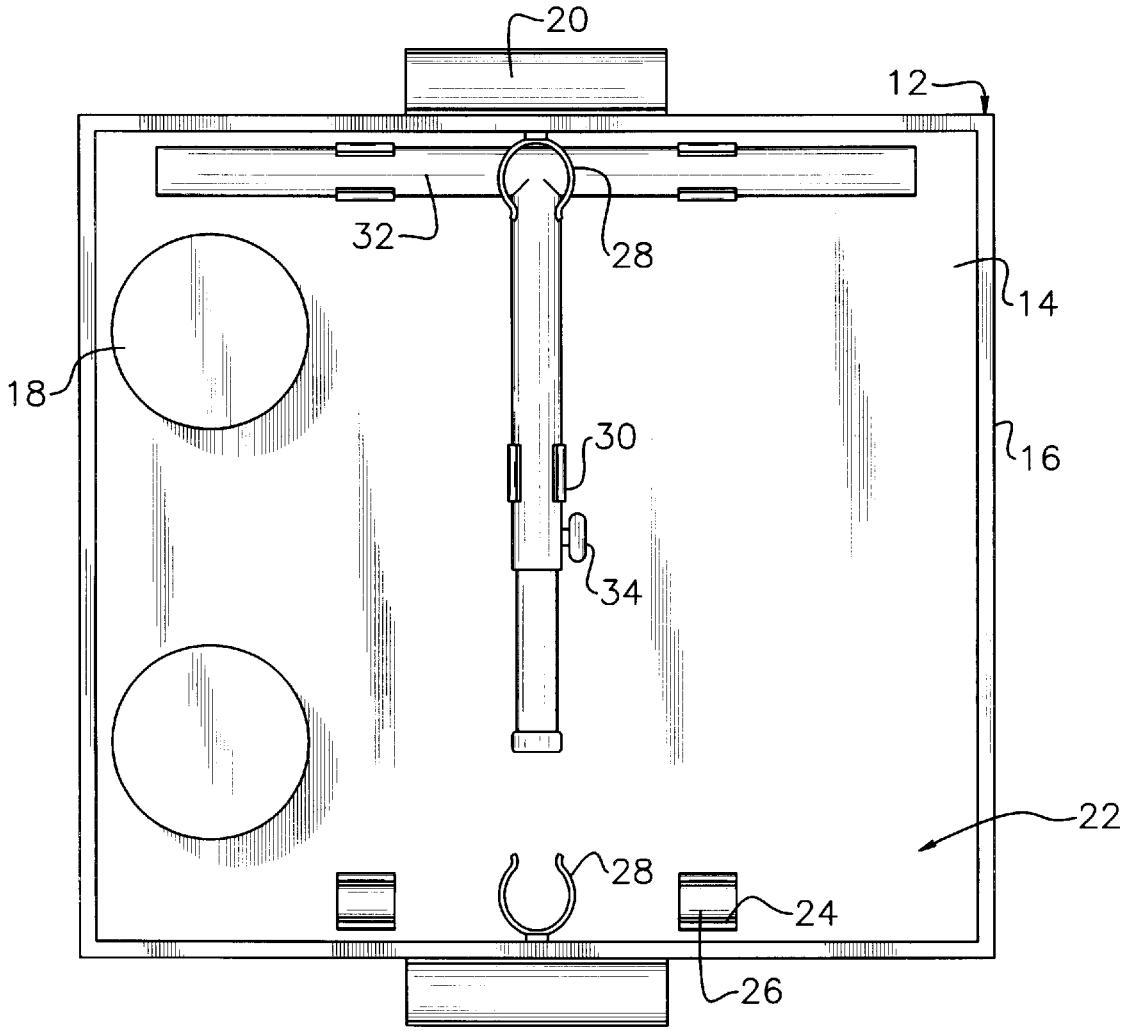
FIG. 3 is a bottom view of the present invention.

With reference now to the drawings, and in particular to FIGS. 1 through 3 thereof, a new chair mounted table embodying the principles and concepts of the present invention and generally designated by the reference numeral 10 will be described.

The present invention, designated as numeral 10, includes a table 12 having a square planar top 14. A peripheral lip 16 is integrally coupled to a periphery of the top and extends downwardly therefrom a constant predetermined distance. The top of the table has a pair of cylindrical recesses 18 formed therein adjacent to a side edge thereof. As shown in FIG. 2, the recesses have a closed bottom with a height equal to the predetermined distance. Further, it is preferred that the recesses be situated closer to a center line of the table than opposed side edges of the peripheral lip, as shown in the Figures.

A pair of clamps 20 are provided each having a length of about ⅓ that of the table. Such clamps further have a C-shaped cross-section along an entire length thereof. The clamps are each situated about a horizontal axis and are connected to a central extent of opposite side edges of the peripheral lip of the table. In use, the clamps function for snappily coupling with a horizontal bar of a lawn chair seat. Preferably, the clamps are removable from the table with a ¾ inch spacer situated therebetween.

Next provided is a leg clamping assembly 22 including a plurality of snap locks 24. Each of the snap locks have a length which is less than ¼ that of the clamps and a C-shaped cross-section along an entire length thereof. As shown in FIG. 3, the snap locks include two pairs of first snap locks 26 situated about a first horizontal axis and mounted to a bottom surface of the top of the table adjacent to the opposite side edges of the peripheral lip. It should be noted that the first snap locks reside along a common axis which is parallel with that of the opposite side edges of the peripheral lip.

The snap locks further include a pair of second snap locks 28 each positioned about a vertical axis. The second snap locks are each mounted to an interior surface of a central extent of an associated one of the opposite side edges of the peripheral lip. Finally, a third snap lock 30 is situated about a second horizontal axis perpendicular with the first horizontal axis. As shown in the Figures, the third snap lock is coupled to a central extent of the bottom surface of the top of the table.

Lastly, a T-shaped leg 32 includes a horizontal extent which is snappily and rotatably coupled between one of the pairs of the first snap locks. A vertical extent of the leg is thus pivotable between a horizontal orientation and a vertical orientation. So that the horizontal extent does not interfere with the second snap lock, it is preferred that the combined height of the horizontal extent and the adjacent second snap lock is equal to a height of the peripheral lip of the table.

In the horizontal orientation, the vertical extent is engaged with the third snap lock. Further, the vertical extent is engaged with a corresponding one of the second snap locks when in the vertical orientation. As shown in the Figures, the vertical extent includes two telescoping components for permitting an adjustable length. Such is accomplished via a set screw 34, as shown in the Figures.

As to a further discussion of the manner of usage and operation of the present invention, the same should be apparent from the above description. Accordingly, no further discussion relating to the manner of usage and operation will be provided.

With respect to the above description then, it is to be realized that the optimum dimensional relationships for the parts of the invention, to include variations in size, materials, shape, form, function and manner of operation, assembly and use, are deemed readily apparent and obvious to one skilled in the art, and all equivalent relationships to those illustrated in the drawings and described in the specification are intended to be encompassed by the present invention.

Therefore, the foregoing is considered as illustrative only of the principles of the invention. Further, since numerous modifications and changes will readily occur to those skilled in the art, it is not desired to limit the invention to the exact construction and operation shown and described, and accordingly, all suitable modifications and equivalents may be resorted to, falling within the scope of the invention.

We claim:

1. A lawn chair attachment comprising, in combination:

a table having a square planar top with a peripheral lip integrally formed to a periphery of the top and extending downwardly therefrom a constant predetermined distance, the top of the table having a pair of cylindrical recesses formed therein adjacent to a side edge thereof;

a pair of clamps each having a length of about ⅓ that of the table and a C-shaped cross-section along an entire length thereof, the clamps each being coupled about a horizontal axis to a central extent of opposite side edges of the peripheral lip of the table for snappily coupling with a horizontal bar of a lawn chair seat;

a leg clamping assembly including a plurality of snap locks each having a length which is less than ¼ that of the clamps and having a C-shaped cross-section along an entire length thereof thereby defining an opening, the snap locks including two pairs of first snap locks mounted about a first horizontal axis to a bottom surface of the top of the table adjacent to the opposite side edges of the peripheral lip along a common axis which is parallel with that of the opposite side edges of the peripheral lip, a pair of second snap locks mounted about a vertical axis to an interior surface of a central extent of an associated one of the opposite side edges of the peripheral lip, and a third snap lock mounted about a second horizontal axis perpendicular with the first horizontal axis to a central extent of the bottom surface of the top of the table; and a T-shaped leg including a horizontal extent which is snappily and rotatably coupled between one of the pairs of the first snap locks and a vertical extent which is pivotable between a horizontal orientation with the vertical extent engaged with the third snap lock and a vertical orientation with the vertical extent engaged with a corresponding one of the second snap locks, wherein the vertical extent has an adjustable length.

2. A chair attachment comprising:

a table with a top and a peripheral lip extending downwardly therefrom;

a leg clamping assembly including two pairs of first snap locks each mounted about a horizontal axis to a bottom surface of the top of the table adjacent to opposite edges of the peripheral lip of the table and a pair of second snap locks each mounted about a vertical axis to an interior surface and on opposite sides of the peripheral lip of the table; and a T-shaped leg including a horizontal portion snappily and rotatably coupled between one of the pairs of the first snap locks and a vertical portion which engages with a corresponding one of the second snap locks in a vertical orientation.

3. A lawn chair attachment as set forth in claim 2:

wherein a pair of recesses are formed in the top of the table along an edge perpendicular with said horizontal axis.

4. A lawn chair attachment as set forth in claim 2 wherein the leg is extendible.

* * * * *